United States Patent [19]

Alberts et al.

[11] 4,093,127

[45] June 6, 1978

[54] DISINTEGRATOR AND SEPARATOR APPARATUS

[75] Inventors: Albert K. Alberts, Bountiful, Utah; Weldon B. Jolley, Redlands, Calif.

[73] Assignee: Life Resources Incorporated, Colton, Calif.

[21] Appl. No.: 624,477

[22] Filed: Oct. 21, 1975

[51] Int. Cl.[2] ..... B02C 23/28

[52] U.S. Cl. ..... 241/55; 241/86.1; 241/89.3; 241/275

[58] Field of Search ..... 241/39, 40, 55, 86.1, 241/89.3, 89.4, 275

[56] References Cited

U.S. PATENT DOCUMENTS

| | | | |
|---|---|---|---|
| 2,474,314 | 6/1949 | Koehne | 241/55 |
| 2,656,988 | 10/1953 | Smith | 241/275 |
| 2,965,318 | 12/1960 | Jordan | 241/46.08 |
| 2,992,784 | 7/1961 | Behnke et al. | 241/275 |
| 3,065,919 | 11/1962 | Burkett et al. | 241/275 |
| 3,549,093 | 12/1970 | Pallmann | 241/55 |
| 3,606,182 | 9/1971 | Warren | 241/275 |
| 3,640,475 | 2/1972 | Jung et al. | 241/55 |
| 3,684,198 | 8/1972 | Pallmann | 241/275 |
| 3,815,833 | 6/1974 | Vliet et al. | 241/39 |

*Primary Examiner*—Granville Y. Custer, Jr.

*Attorney, Agent, or Firm*—Romney, Schaap, Golant, Scillieri, Disner & Ashen

[57] ABSTRACT

Disintegrator and separator apparatus and method, having a pulverizing chamber with a rotary impeller therein for imparting acceleration to raw material received through an inlet. The impeller includes a pair of spaced apart discs having a plurality of blades connected between the discs at their outer edge, with a drive shaft connected to only one of the discs, leaving the middle of the pulverizing compartment open. A peripheral impact surface in the pulverizing chamber has a portion of its inside wall facing radially inwardly and aligned in the direction of rotation of the blades. One embodiment includes a plurality of overlapping peripheral impact blades which include an outlet passage between each pair of adjacent plates; a second embodiment includes a peripheral impact ring having outlet slots therethrough; and a third embodiment includes a peripheral impact ring having a concave inner surface, with outlet passages adjacent both sides thereof around the circumference of the ring. Rotating the materials at a high speed greater than 2000 RPM to maximize attrition by particle/particle impact without separate fan means.

3 Claims, 5 Drawing Figures

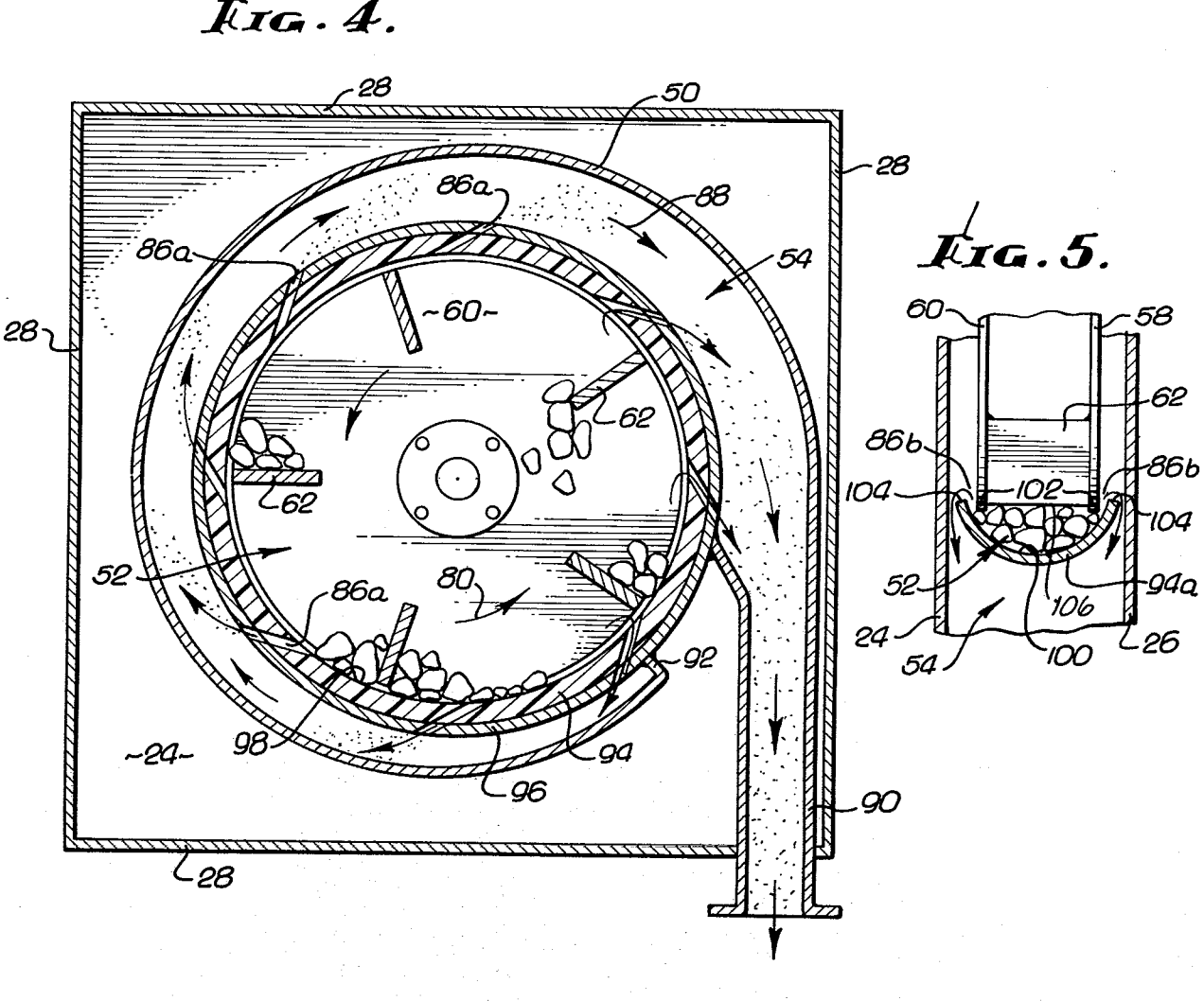
FIG. 4.
FIG. 5.
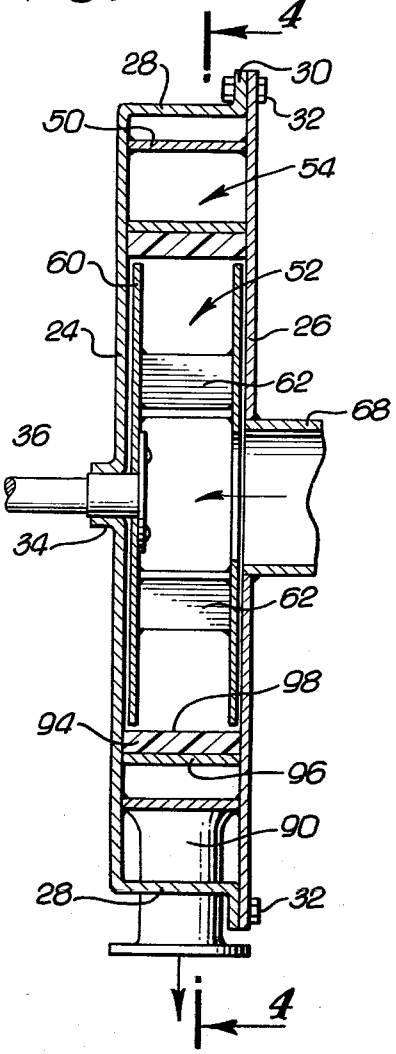
FIG. 3.

DISINTEGRATOR AND SEPARATOR APPARATUS

This invention relates generally to the disintegration and separation of raw materials, and more specifically to a disintegrator and separator apparatus and method having a pulverizing chamber with a rotary impeller therein for accelerating the air and material around said chamber, to strike peripheral impact elements, with outlet passages for drawing off the air and the material which has been sufficiently disintegrated for separation from the raw material by passage through the outlet.

A wide variety of pulverizing devices have been built which utilize a rotary impeller inside a pulverizing chamber. However, such prior devices have traditionally been very inefficient to operate because of the excessive enrgy needed to crush and break apart the raw material being processed. Additionally, the crushing has traditionally been done by installing impact plates transverse to the direction of rotation of the impeller for blocking and/or substantially changing the direction of the material to provide maximum breaking forces on large particles as they are propelled directly against the impact plates. The deflection of the partially broken particles away from the impact plates occurs in various directions, thus striking the sides of the pulverizing chamber and/or the impeller blades which again thrust the particles forwardly for repeated direct collision against the impact elements.

The operation of the aforementioned conventional crushing and pulverizing devices causes excessive wear of the peripheral impact elements, and the impeller blades, and results in rather haphazard non-uniform uncontrolled pulverization. Moreover, specialized custom built units must usually be made for each different type of material involved, and even with such specially designed pulverizing units, it has been difficult to separate out the pulverized material from partially pulverized or raw material which is usually being continually fed into the machine. Finally, such machines create excessive noise and are continually breaking down due to the extreme stresses and strain resulting from the high-momentum direct impact taking place in the pulverizing chamber.

Accordingly, it is a primary object of the present invention to provide an improved method and apparatus for pulverizing and disintegrating all types of materials in a single unit, and to provide a method of closely controlling the size of the particles which are discharged from the pulverizing chamber.

A further object of the invention is to provide a disintegrator and separator apparatus which can operate reasonably quietly and efficiently on a reasonable power consumption, while at the same time providing controlled disintegration of the raw material to a predetermined size, and separation and discharge of said material from the pulverizing chamber.

Another object is to provide a device of the aforementioned characteristics which generates sufficient air flow by the impeller itself to eleminate the need for an auxilliary air flow fan.

A more specific object is to provide a pulverizing unit which rotates an impeller and the raw material therein at a high rate of speed while at the same time minimizing the high-stress impacts of said material with the peripheral impact element and the impeller blades. The related object is to provide a rotary impeller having a pair of spaced apart disks joined together at their periphery by a plurality of blades, with a drive shaft connected externally to only one of said disks, to leave the center portion of the pulverizing chamber free and clear to maximize particle/particle impact and to minimize the impacts of the particles with the structure of the device.

Another object is to provide a device of the aforementioned characteristics which includes a peripheral impact surface which is tangentially aligned with the rotary movement of the blades to minimize the wear on said impact surface and to maximize the accelleration of the particles in a general rotary direction.

Another specific object is provide different versions of the peripheral impact surface which can be installed for optimum disintegration and separation of a particular type of material. More specifically, it is an object of the invention to provide one embodiment having peripheral impact plates which have a forward end overlapping a rearward end of an adjacent plate, with a large portion of the inner face of the plate directed radially inwardly.

Another object is to provide a second embodiment of the invention having certain of the aforementioned characteristics wherein the peripheral impact surface is in the form of a ring having an outer reinforcing portion and an inner impact portion, with slots passing therethrough. The related object is to provide an impact ring where the impact surface is made of plastic such as polyurethane.

Another object is to provide a third embodiment of the invention wherein the impact surface is concave inward across its radial cross-section, sufficiently to allow larger size particles of the material to build up on said surface to provide an impact coating thereon.

Further purposes, objects, features and advantages of the invention will be evident to those skilled in the art from the following description of the various exemplary embodiments of the invention.

In the drawing:

FIG. 3 shows a vertical cross-sectional view of a second embodiment of the invention having a modified impact surface around the periphery of the pulverizing chamber;

FIG. 4 is a sectional view of the embodiment of FIG. 3 taken along the line 4—4 in FIG. 3; and FIG. 5 shows an enlarged fragmentary cross-sectional view of a third embodiment of the invention having another form of impact surface around the periphery of the pulverizing chamber.

Figure 2:
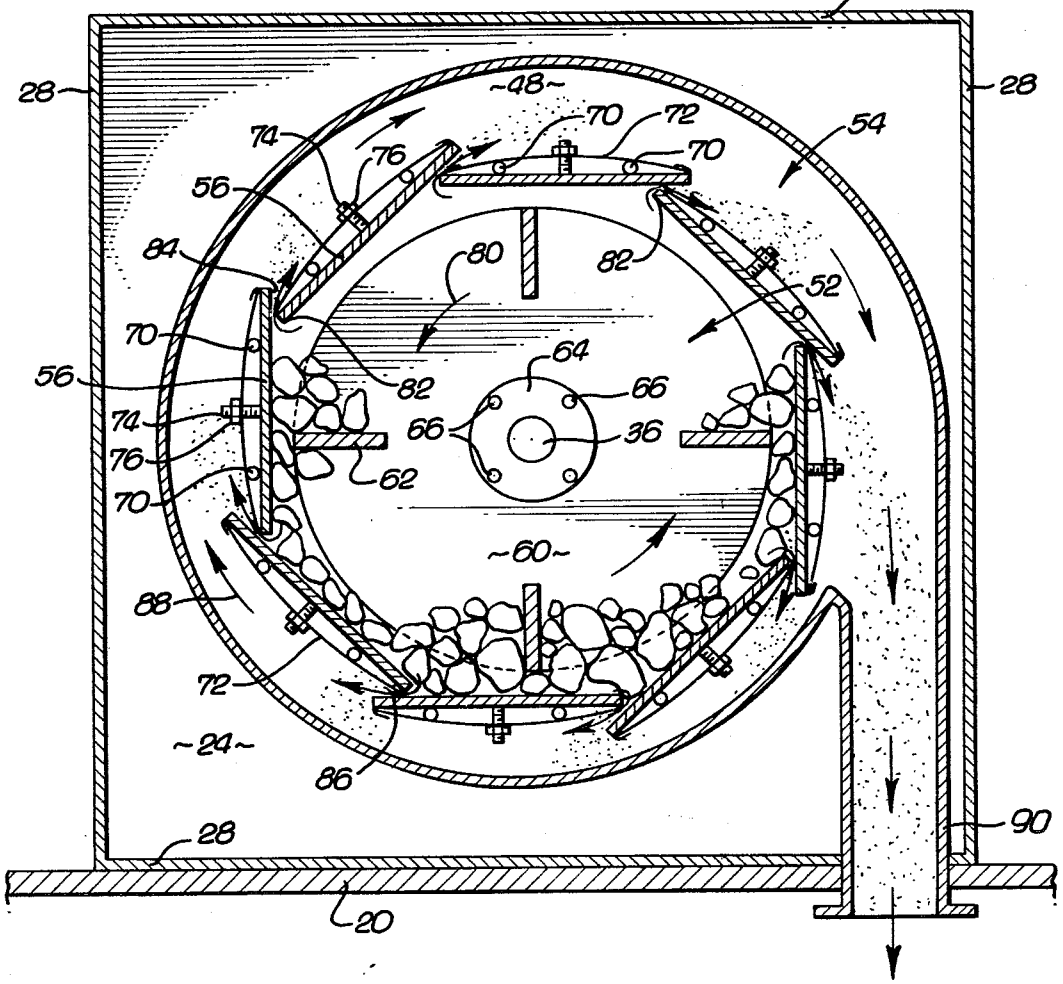
FIG. 2 is a sectional view taken along the line 2—2 in FIG. 1.
Figure 1:
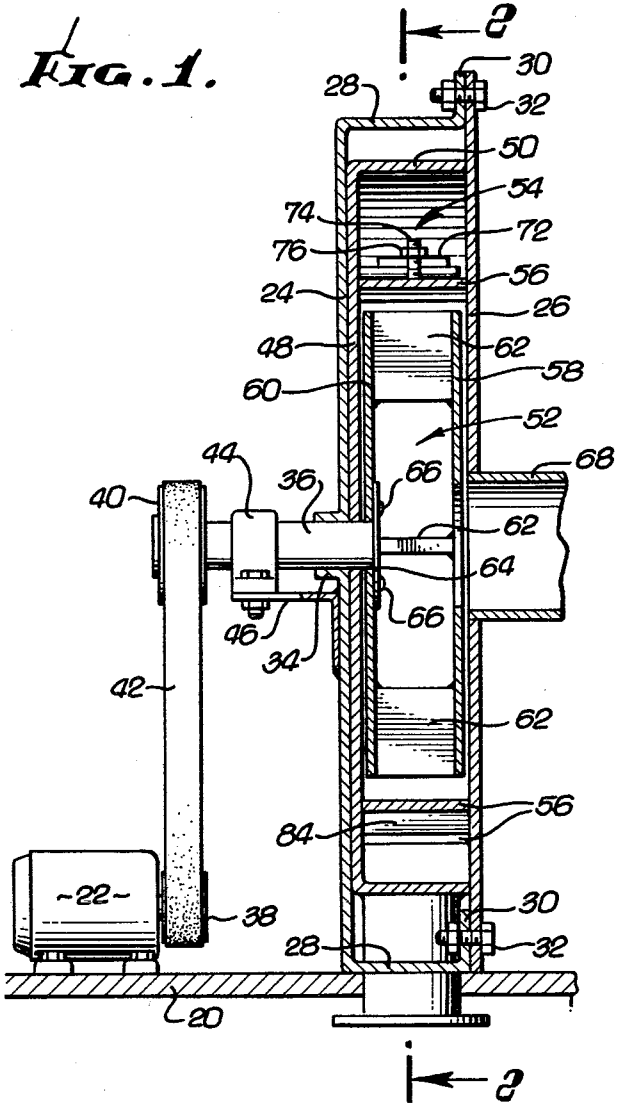
FIG. 1 is a vertical cross-sectional view of a presently preferred embodiment of the invention showing a disintegrator and separator unit mounted with its drive motor on a horizontal base plate.

As shown in the drawings of FIGS. 1 and 2, a presently preferred embodiment of the invention includes a frame 20 having a motor 22, a casing 24, and a front panel 26 all mounted on the frame. In the example shown, the casing 24 is rectilinear having four edge portions 28 which are suitably connected through upturned flanges 30 by threaded fasteners 32 to the upstanding front panel 26. The back portion of the casing 24 includes a circular bearing flange 34 for journaling a horizontal drive shaft 36. The linkage between the drive shaft and the motor in the exemplary form may include a motor pulley 38, a shaft pulley 40, a belt 42, another shaft bearing 44, and a support bracket 46. As shown in FIG. 1, the bearing 44 journals the intermediate portion of the drive shaft 36, and is connected to the back of the casing 24 by a support bracket 46. The shaft pulley 40 is mounted on the rear end of the drive shaft and is linked to the motor pulley 38 on the motor 22 by the belt 42.

A processing chamber is formed inside the casing by a back panel 48 having an edge portion 50 which abutts the front panel 26. The processing chamber is divided into a central compartment 52 and an external compartment 54 by a peripheral impact surface. In this embodiment, the impact surface is formed by plurality of elongated impact plates 56 in the central compartment. A rotary impeller is formed by front and back disks 58, 60, and plurality of impeller blades 62. Since the front and back disks are substantially parallel and are disposed immediately adjacent to the substantially parallel front and back panels, respectively, it is the disks which define the front and back boundaries of the central compartment wherein the disintegration of the raw material occurs.

In order to leave the central compartment free the front end of the drive shaft 36 passes through an aperture in the back panel and back disk 48, 60 for attachment to only the back disk by means of a circular mounting plate 64 and suitable fastener 66. Since an inlet pipe 68 passes through the center portion of the front panel 26 and communicates through a similarly sized aperture in the front disk 58, the raw material can enter into and be agitated within the central compartment 52 with full freedom of movement within the middle portion of the central compartment. In this regard, the impeller blades 62 are preferably welded between the peripheral edges of the front and back disks 58, 60 to provide a unitary impeller fixedly mounted on the drive shaft for high-speed rotation without including any supporting or impact structure in the middle of the compartment.

The number of impeller blades 62 shown in the embodiment of FIGS. 1 and 2 is exemplary only, as is the number of impact plates 56.

Referring specifically to the details of the illustrated embodiment, eight impact plates 56 are shown mounted on the back panel 48 by means of the same number of pair of rods 70 extending from the back panel. Each plate includes a rear flex bar 72 on the back side having a central stud 74 extending therethrough. Thus, each plate can be removably inserted over the rods 70 and a nut 76 on the stud tightened to hold the flex bar 72 and the back of the plate in tight frictional engagement with the rods 70.

A substantial portion of the inner face 78 of each impact plate is facing radially inwardly and is aligned in the direction of rotation of the impeller blades 62. As a result, the inner surface of the impact plates tends to serve primarily as a directional surface moving the material along in the direction of rotation 80 of the impeller, thus minimizing the high-stress breaking impact which was previously intended to occur in prior art devices. In order to provide proper separation of the particles in the central chamber, the forward end or edge 82 of each plate is immediately inside and overlaps the trailing end or edge 84 of the adjacent plate to define an outlet passage from the central compartment.

In order to facilitate control over the separation, a directional path between adjacent plates is at an obtuse angle relative to the direction of rotation 80 of the blades. Additionally, the shape and size of the external compartment 54 is designed to carry the air and materials expelled through passages 86 in an opposite direction 88 around the external compartment into an outlet pipe 90 which extends downwardly through the casing 24 and the frame 20 to a collection area.

In the exemplary form, the full impeller blades 62 are shown which extend from the peripheral edge of the disks 58, 60 only one half of their radial dimension, although it would be possible to vary the radial dimension of the blades and their outermost edge to terminate short of or beyond the peripheral edge of the disks 58, 60 without departing from the spirit of the invention.

Although embodiment just described is oriented a given way on the frame 20, the invention will also be applicable to units which are rotated on a vertical axis or some other orientation which may be suitable for the particular installation involved.

It will thus be appreciated by those skilled in the art that the foregoing construction enables high-speed rotation by a low horsepower motor sufficient that hundreds of pounds of material per hour can be processed by the invention with little or no wear occurring on the impact plates and impeller plates. In addition, the casing serves to insulate the operator from any excessive noise or leakages which may occur as a result of the agitation inside the pulverizing chamber.

Referring now to the embodiment of FIGS. 3 and 4, it will be noted that the external compartment 54 may be closed off as at 92 to assure that air and material collected in the external chamber will be carried to the outlet pipe 90 in a direction 88 which is opposite to the direction of rotation 80 of the impeller. Moreover, the number of impeller blades 62 has been change to five. The same number of passages 86*a* are provided, although this could be varied without departing from the spirit of the invention.

Referring more specifically to FIGS. 3 and 4, it will be noted that the impact plates 56 have been replaced by a ring 94 having an outer reinforcing portion 96 and an inner impact surface 98. Otherwise, for purposes of illustration, the alignment of passages 86*a* are somewhat similar to the passages 86 of the previous embodiment. In this regard, when viewed from the central compartment, the passages 86*a* constitutes slots extending transversely across the inner surface of the ring, leaving a margin of the ring intact on the front and/or back edge to hold the ring together. Of course, it is within the spirit of the invention to provide suitable fasteners, such as shown for the embodiment of FIGS. 1 and 2, for removably and replaceably mounting either the plate 56 or the ring 94.

This makes it easy to replace impact elements when the need arises.

Of course, the ring could be made of a single material, but the utilization of polyurethane or other similar plastic materials serves to minimize the problems arising from the contamination of the process material due to the impact surface being broken down. In this regard, any contamination by the plastic surface due to abrasion may be removed from the final product by merely heating the material to a sufficiently high temperature to break down the plastic which then goes off as carbon dioxide, water, and certain volatile products. This feature is extremely valuable when it is commercially desirable to preclude the intrusion of any metalic contaminant such as in the production of fine abrasives.

It will be appreciated by those skilled in the art that the present invention can be utilized for materials of varying hardness. For example, it has been found suitable for material such as clay or coal which are relatively non-hard substances as well as for very tough material like taconite or extremely hard material such as aluminum oxide. The invention has also been tested to establish its application in the breakdown and pulverization of organic material such as wheat, triticale, carob, dehydrated carrots and many other organic substances.

Referring to the embodiment of FIG. 5, a modified inner ring 94*a* is provided which has an inside wall 100 which is concave in its transverse cross-section, having a sufficient depth to allow the raw material in the pulverizing chamber to build up and form a protective impact coating. In order to control the separation of the pulverized material, the outer edges 102 of the disks 58, 60 are positioned a predetermined distance from the innermost edges 104 to provide passages 86*b* between the central and external compartments which passages extend circumferentially around the ring along both sides thereof. Additionally, the outermost edges 106 of the blades are located a predetermined distance away from the inner concave wall 100 to prevent any material from leaving the central compartment other then through the passages 86*b*. Thus, the coarser particles of the material provide the impact surface against which the moving particles are impelled. In order to obtain the full benefit of this feature of the invention, the modified ring 94*a* can be mounted on a conventional separately driven rotary hub (not shown) which carries the ring on a spoke member extending between the hub and the outside ring wall, so the ring is revolved to create a centrifugal force which holds the coarser particles in the ring, thus providing what might be characterized as a centrifugal lining against which the agitating material impinges when it is thrown out by the impeller during the pulverizing process. The revolving speed of the modified ring 94*a* for achieving the required centrifugal force is relatively slower than the high-speed rotation of the impeller.

Thus, the foregoing embodiments all utilize a peripheral impact surface in the pulverizing chamber which is substantially aligned with the rotation direction of the impeller and which faces radially inwardly to achieve directional guidance of the rotating material with only a minimum of energy dissipated or absorbed by the impact surface. Moreover by utilizing the foregoing structure and method in a pulverizing unit which rotates the impeller in a high-speed range more than 2000 RPM, maximum attrition occurs through particle/particle impacts rather than impacts against the stationary and moving structural parts in the pulverizing chamber.

Although exemplary embodiments of the invention have been disclosed and discussed, it will be understood that other applications of the invention are possible and that the embodiments may be subjected to various changes, modification, and substitutions without necessarily departing from the invention.

We claim as our invention:

1. A device for disintegrating and separating raw materials including in combination:

a processing chamber formed by back and front parallel panels spaced apart from each other and joined together at their outer edges;

an impact wall within said processing chamber displaced inwardly from said outer edges of said panels, to divide said processing chamber into a central compartment with an external compartment including deflection means comprising the longitudinal face portion of a plurality of plates for deflecting material back into the central compartment to achieve inter-partical impacts, including passage means between opposite ends of said plates for connecting said central compartment with said external compartment;

a drive shaft passing through said back panel into said central compartment;

a casing member surrounding said processing chamber to form an insulation space between said casing member and said processing chamber, including bearing means for journaling said drive shaft;

a rotary impeller for accelerating both air and raw material inside said central compartment, and having back and front discs connected by a plurality of transverse blades normal to the direction of rotation of said impeller and extending between the periphery of said disks, said blades extending inwardly less than half the radial dimension of said disks and extending outwardly without projecting beyond the periphery of said discs, with said drive shaft attached to and terminating with said back disk leaving the middle of said central compartment open and wherein said longitudinal face portion of said plates is aligned with the direction of rotation of said impeller as well as perpendicular to the respective adjacent blades;

motor means located outside of said processing chamber and outside of said casing member, which motor means is attached to said drive shaft which passes through said insulation space into said central compartment for rotating said impeller;

inlet means communicating through said casing member, said front panel and said front disk with said middle of said central compartment for receiving a supply of air and of the raw material; and outlet means communicating through said casing member with said external compartment for discharging the air along with the disintegrated and separated material.

2. A disintegrator and separator device having a pulverizing chamber with a rotary impeller therein for imparting acceleration to raw material received through an inlet, including in combination:

a peripheral impact surface in the pulverizing chamber comprising a ring having a portion of its inside wall facing radially inwardly and substantially parallel to the direction of rotation of said impeller, wherein said impact surface is formed of a plastic material; and passage means communicating from said pulverizing chamber past said inside wall of said ring to a discharge outlet for carrying air as well as material of a predetermined size and mass away from said pulverizing chamber.

3. A disintegrator and separator device having a pulverizing chamber with a rotary impeller therein for imparting acceleration to raw material received through an inlet, including in combination:

a peripheral impact surface in the pulverizing chamber comprising a ring having a portion of its inside wall facing radially inwardly and substantially parallel to the direction of rotation of said impeller and wherein said inside wall has a portion which is concave in its transverse cross-section relative to the pulverizing chamber;

passage means communicating from said pulverizing chamber past said inside wall of said ring to a discharge outlet for carrying air as well as material of a predetermined size and mass away from said pulverizing chamber;

wherein said rotary impeller includes a plurality of blades on the outer edge of said impeller displaced sufficiently from said concave portion of said inside wall to allow the raw material in the pulverizing chamber to build up and form a protective impact coating in said concave portion; and wherein the peripheral boundary of the pulverizing chamber is defined by said ring and a pair of spaced-apart disks having said blades mounted therebetween, wherein the outer edges of said disks and blades of said impeller are positioned a predetermined distance from the innermost edges of said concave portion of said inside wall to form said passage means adjacent both side margins of said ring.

* * * * *